US009790724B2

(12) United States Patent
Ivanovic et al.

(10) Patent No.: US 9,790,724 B2
(45) Date of Patent: Oct. 17, 2017

(54) HOUSEHOLD APPLIANCE WITH DOOR DAMPER

(71) Applicant: Electrolux Appliances Aktiebolag, Stockholm (SE)

(72) Inventors: Branko Ivanovic, Rothenburg ob der Tauber (DE); Dietmar Hildner, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/117,658

(22) PCT Filed: Mar. 30, 2015

(86) PCT No.: PCT/EP2015/056827

§ 371 (c)(1),
(2) Date: Aug. 9, 2016

(87) PCT Pub. No.: WO2015/150296

PCT Pub. Date: Oct. 8, 2015

(65) Prior Publication Data

US 2016/0348414 A1 Dec. 1, 2016

(30) Foreign Application Priority Data

Mar. 31, 2014 (EP) ..... 14162707

(51) Int. Cl.
*A47B 49/00* (2006.01)
*E05F 5/02* (2006.01)
(Continued)

(52) U.S. Cl.
CPC ..... *E05F 5/02* (2013.01); *F24C 15/021* (2013.01); *H05B 6/6414* (2013.01); *E05Y 2900/308* (2013.01)

(58) Field of Classification Search
CPC ..... E05F 5/02; F24C 15/021; H05B 6/6414; E05Y 2900/308
See application file for complete search history.

(56) References Cited

U.S. PATENT DOCUMENTS

2009/0165244 A1* 7/2009 Pyo ..... E05F 5/006 16/250
2010/0258986 A1* 10/2010 Chen ..... E05F 5/02 267/124

(Continued)

FOREIGN PATENT DOCUMENTS

DE 2545531 A1 4/1977
DE 19835217 C1 12/1999

(Continued)

OTHER PUBLICATIONS

International Search Report issued in PCT/EP2015/056827 dated Jul. 15, 2015, 3 pages.

*Primary Examiner* — Hanh V Tran
(74) *Attorney, Agent, or Firm* — Pearne & Gordon LLP

(57) ABSTRACT

A door damper (100) is made preferably of heat-resistant plastic material and comprises a damper element (150) as well as a pestle (110) that is securely guided in the housing (120) of the door damper. As an integrated structure, it can be mounted at any suitable location at a household appliance (160) that is cool and the pestle (110) can directly contact the front door (220, 300). Beneficially, it comprises an orifice (140) at the housing (120) to fix it at a sidewall of a household appliance (161) or at the front door (220, 300). Beneficially, the door damper also comprises a switch (145) that allows switching a door alarm, a light or influencing cooking functions.

19 Claims, 2 Drawing Sheets

(51) Int. Cl.
*F24C 15/02* (2006.01)
*H05B 6/64* (2006.01)

(56) References Cited

U.S. PATENT DOCUMENTS

| | | | | |
|---|---|---|---|---|
| 2010/0281650 | A1* | 11/2010 | Kleemann | A47L 15/4261 16/64 |
| 2011/0068671 | A1* | 3/2011 | Vanini | E05F 5/02 312/405 |
| 2011/0094055 | A1* | 4/2011 | Domenig | E05F 5/02 16/83 |
| 2011/0094056 | A1* | 4/2011 | Lautenschlager | E05F 5/02 16/84 |
| 2012/0260461 | A1* | 10/2012 | Lautenschlager | E05D 3/14 16/352 |
| 2013/0063011 | A1* | 3/2013 | Kozinski | A47L 15/4261 312/319.2 |
| 2013/0160242 | A1* | 6/2013 | Brunnmayr | E05F 5/006 16/286 |
| 2013/0312220 | A1* | 11/2013 | Elkasevic | E05F 1/1261 16/327 |
| 2014/0165333 | A1* | 6/2014 | Brunnmayr | E05F 5/006 16/319 |

FOREIGN PATENT DOCUMENTS

| | | | |
|---|---|---|---|
| DE | 10103949 | A1 | 8/2002 |
| DE | 102007029696 | A1 | 1/2009 |
| DE | 102007032758 | A1 | 1/2009 |
| DE | 102008018867 | A1 | 10/2009 |
| GB | 2252787 | A | 8/1992 |

* cited by examiner

HOUSEHOLD APPLIANCE WITH DOOR DAMPER

In present household environments, security and comfort is becoming more and more important, as customer expectations in terms of ease of use of the devices, appearance and functionality are constantly rising. In many household appliances, such as ovens, microwaves or the like, hinged doors furnished with glass are used to allow a visible inspection of cooking goods while they are prepared and the oven is running. Sometimes, during cooking or boiling, intermediate preparation steps are required that necessitate the opening and closing of the door of the oven cavity. Here, it is a prerogative in order to save energy to close the oven door as soon as possible in order to contain the heat inside of the oven cavity as much as possible.

Usually, in combination with such hinged doors, a spring-loaded mechanism is used that rapidly closes the door under the influence of the spring. Here the problem arises how to protect the glass that is fixed inside the door from crashing when the door is rapidly closed as well as to avoid highly undesired noises that diminish the quality impression of the household appliance.

The publication document DE 10 2007 029696 A1 discloses a household appliance, and especially an oven. Here, according to FIG. 2, a pestle attached to a hydraulic or pneumatic damper and under springload is used to cushion a door when it is closed. The tip of the pestle is equipped with a second elastic damping element.

The invention is based on the problem to improve the closing of a glass-equipped door in the presence of a heated environment.

This problem is solved by household appliance according to claim 1.

Further developments of the invention are given in the dependant claims

Beneficially, the door damper according to an embodiment of the present invention combines all essential components required to dampen a door while it is closing in a single housing that secures the damper, the pestle and a bracket. Thus it can easily be manufactured and flexibly configured to be placed at a proper location in a household appliance, where it is minimally exposed to heat and optimally positioned in terms of appearance and function.

In this manner, a secure door operation is guaranteed, while at the same time providing optimum design flexibility and rigidity of the door damper and thus improving the overall performance of the household appliance while at the same time facilitating the manufacturing and the design of it.

A door damper arrangement according to the present invention comprises a minimum number of components, respectively a door, a hinge and a door damper, which is mounted in a region of the household appliance, which is in proximity to the hinge. In this manner, a flexible solution is provided that allows it to position the door damper anywhere on or close to the door or on an oven cavity side giving utmost flexibility in the design and construction of a household appliance.

The household appliance, in particular an oven, comprises a door, which is supported at a hinge and a door damper, which is mounted in a region of the household appliance, which is in proximity to the hinge, and having at least one cavity, preferably arranged opposite to the door, defining an opening plane section on that side.

The door damper comprises a damper element and a pestle which is in force transmitting contact with the damper element, wherein the door comprises a support frame for supporting at least one glass panel, having at least one section where said support frame has a section which supports at least two sections of said one glass panel, and wherein the pestle is arranged in such way, that it comes in contact to the door in said section of the support frame, supported in particular on that side of the section, which is opposite to the glass panel. Thus, stability of the glass panel is improved and the damping action is executed more safely.

The pestle provides a front surface, which is in contact to the door when the door is positioned in or within an angle (280) relative to the opening plane, the angle being an angle between the door and the opening plane.

Thus, the pestle is actuated.

Further beneficially, the front surface of the pestle is formed such that the front surface is formed in an angle corresponding to the angle and/or is convex and/or is oval and/or is semicircular and/or is tapered and/or is rectangular and/or is flat. Thus, the form of the front surface can be adjusted accurate to the form of the door or the form of mechanical structures mounted to the door or to an specific angle of the opened door.

Advantageously, the pestle is fixed to the damper element and/or wherein the length of the pestle is preferably at least partially adjustable. In this manner, an additional manufacturing step can be saved, and thus the manufacturing of the door damper according to the present invention is facilitated and the length of the pestle can be minimized or increased in order to adjust the pestle to different kind and dimensions of door.

Beneficially, the door will actuate the pestle preferably at an angle (280) between 0° and 30°, or more preferably at an angle between 5° and 25°, or most preferably an angle between 0° to 10°.

Beneficially, it is manufactured from plastic material because plastic material can be e.g. injection-molded and constructed in two halves that allow an easy assembly of the household appliance and fixing by a bracket. Preferably, the plastic material used for manufacturing the door damper is preferably made of high temperature-resistant material that withstands temperatures up to 350° C. In this manner, even more flexibility in the placement of the door damper can be achieved.

Beneficially, the shape of the pestle is adapted to operate the switch. In this manner, e.g. by positioning a notch along the shaft of the pestle, the timing and the action of the switch can be exactly predetermined in terms of the position of the door in contact with the pestle.

Advantageously, the pestle is equipped with a specific notch. In this manner, switching action can be effected in an efficient, easy-to-manufacture way, as the pestle can be e.g. injection-molded with a notch of the proper shape and at the proper location on the pestle.

Advantageously, the damper element is based on hydraulics or gas and operates in a linear or progressive manner in terms of damping activity.

Favorably, the door damper is fixed on a substructure or a support structure that also supports a hinge of a door support arrangement. In this manner, a sub-assembly containing a hinge part and the door damper can be prefabricated and be mounted with the door in one manufacturing step.

Advantageously, the door damper is mounted on the door. Thus, it is easily accessible and can be sub-assembled together with the door or frame parts of the door and also positioned in an optimum manner in order to protect the glass that is supported by the door. The door damper can be also mounted in the neighbor-hood of the hinge and thus can be independently mounted at the proper location without having to consider the functionality of the hinge and its construction, thus securely not obstructing the hinge mechanism.

Beneficially, the door damper arrangement according to a further development of an embodiment of the present invention comprises a structure to actuate the pestle in dependency of a certain angle that the door forms e.g. with an oven cavity. Advantageously, according to a further development, the door damper is arranged on and/or in a region of a double fulcrum hinge, which is preferably spring-loaded.

Beneficially, the door damper and/or the pestle is actuated by the door when a first force, which is provided by the hinge and applied to the pestle via the door, is reached, which exceeds a second force, which is preferably a counterforce provided by the door damper and/or the pestle, preferably when the first force and the second force are adapted to each other such that the door closes automatically with a predetermined closing speed, at least when positioned in an angle between 0° and 30°.

Advantageously, the door damper can be fixed directly on a hinge and/or at the associated mechanical parts.

Beneficially, the door damper comprises a housing, having a bracket. The pestle is guided by the housing.

Favorably, a switch is integrated within it and the pestle may be in connection to the switch, providing even more flexibility and allowing to effect a switching action being combined with the door damper, and thus provides even more flexibility in the design of a door closing mechanism and the associated functionality. For instance, a light can be switched on and off or cooking-related functions of an appliance can be suspended, such as a fan being switched off or a microwave being switched off. Here, beneficially a micro switch can be also actuated in order to switch a light, a door lock system or a corresponding warning system, or to suspend/activate cooking-related functions of an oven.

Subsequently, the invention will be further explained on the basis of examples shown in drawings, wherein.

Figure 1:
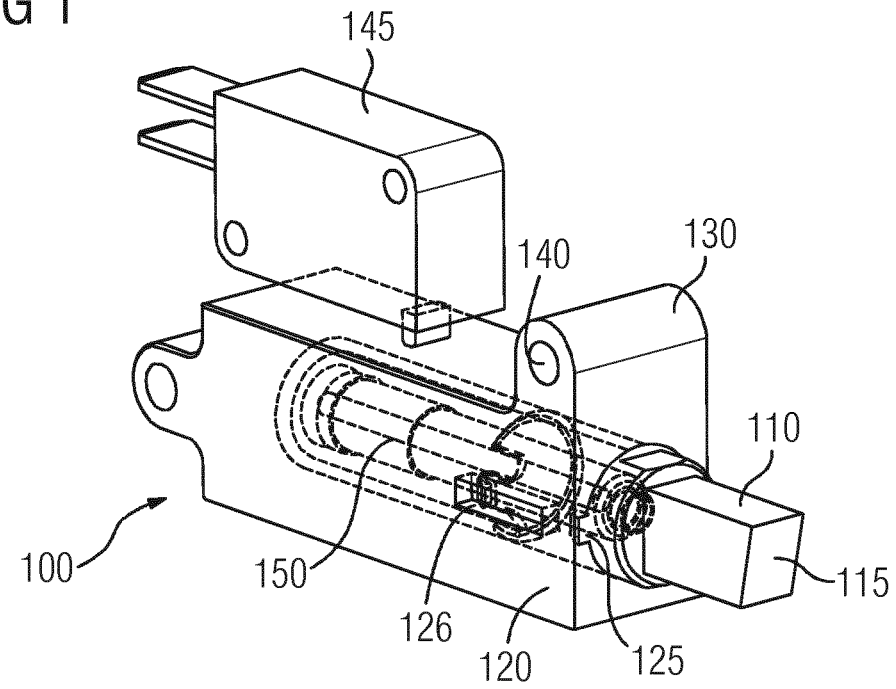
FIG. 1 shows an example of a door damper.

FIG. 1 shows an example of an embodiment, especially a preferred one of a door damper 100 according to the present invention. Beneficially, the housing 120 is made of plastic material, and in particular of high temperature-resistant plastic material that withstands up to 350° C. The housing can be built modular and optimally secures a pestle 110, as well as a damper element 150. The housing 120 may e.g. be fixed by a bracket 130 that secures e.g. two halves of the housing together.

E.g. further functions of a bracket 130 are to hold a hinge, a side wall, a front frame as well as a cavity, together. Further-more it may be used to hold the damper element 150.

Any other number of subparts of a housing are conceivable as needed.

Further, the housing may provide a particular guide 125 for the pestle 110 and include a switch 145, which is not shown in de-tail. Further guides maybe provided inside of the housing 120 to support the pestle 110.

Specifically, the pestle 110 may be guided by a front slot 125 as well as by a side slot 126 of the housing 120 providing it more stability in its movement. The front contact surface 115 of the pestle 110 may be inclined to accommodate a contact surface at e.g. a door which operates the pestle 110, or may be arched to accommodate just a line contact e.g. with a door. Such an arched construction causes lesser friction during operation.

Beneficially, the housing 120 comprises an orifice or any other means 145 for fixing the housing respectively the door damper in its proper location.

Beneficially, the housing 120 can be adapted to be usable with different dampers or the use of a damper element 150 with different housings. In this context the exterior appearance of the housing 120 can be e.g. the same while the components such as damper element 150, pestle 110 and switch 145 are different.

Figure 2:
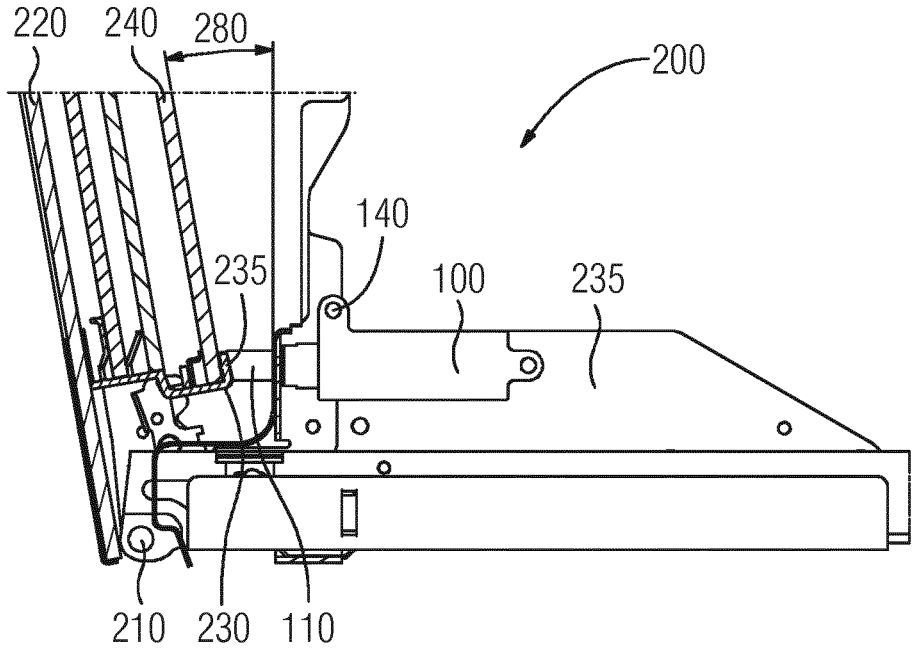
FIG. 2 shows an embodiment of a door damper arrangement according to the present invention.

As FIG. 2 shows, an example of an embodiment of a door damper arrangement 200 according to the present invention comprises a door 220 that is equipped with glass 240 and supported at a hinge 210. In this case, the door is opened forming an angle 280. The pestle 110 contacts the door via a substructure 230 that actuates the pestle. In this case, the door damper 100 is mounted to a substructure 235 that also holds the hinge 210. In this manner, the manufacturing of a household appliance can be facilitated in that the door damper can be sub-assembled together with the hinge to form a single manufacturing part.

Beneficially, an orifice 140 serves to fix the door damper 100 to the substructure 235.

Beneficially, the door will actuate the pestle by means of support frame 230 forming part of the glass 240 or the door 220 at a predetermined angle 280 between 0 to 30°, or preferably at an angle between 10 and 30°, or even more preferably between 5° and 25°. Here, beneficially a micro switch can be also actuated in order to switch a light, a door lock system or a corresponding warning system, or to suspend/activate cooking-related functions of an oven.

The door damper can be placed close to a hinge area at opposing sides of an oven door and behind a mechanical structure of an oven door, such as a front frame.

Further, the door damper due to its design can be placed at a cool area of e.g. a front frame, but still in an area where it may be contacted by the front glass. In terms of an optical appearance, beneficially the only visible component is the pestle, which favorably has direct contact to a glass surface or to a door mechanical structure. In order to further improve the design, the pestle can beneficially be fixed on the piston rod of the damper element 150.

Beneficially, the damper element 150 operates on the basis of hydraulic or pneumatic damping. Further, beneficially, it may feature linear or progressive damping characteristics in order to further improve the functionality of the door damper arrangement and protect the glass from breaking respectively unwanted noises from being generated when the door is automatically closed.

Further beneficially, a switch 145 can be integrated within the door damper 100. Various alternatives for fixing the housing 120 of the door damper 100 can be pursued due to its design. Beneficially, it can be fixed by means of screws or snap connections directly on a front mechanical structure or at the sidewall of an oven cavity where it can be placed into a bracket.

Further, beneficially, in case of furniture-mounted household appliances, the door damper is fixed on a sidewall of the household appliance 165, as due to the presence of the furniture, the fixing elements will not be seen from outside. On the other hand, the door damper 100 with its housing 120 can be placed directly on a bracket which also supports the hinge, or on a support structure for the front frame, cavity, or sidewalls. Beneficially, it can also be mounted on the rear side of a front frame support structure.

Beneficially, due to its modular design, the door damper according to an embodiment of the present invention can be used as well in combination with a single oven cavity 162 as in combination with two oven cavities 161, 162. For instance, two door dampers can be applied at different locations. Further, the door damper can also be fixed directly on a hinge or at the associated mechanical parts.

Figure 3:
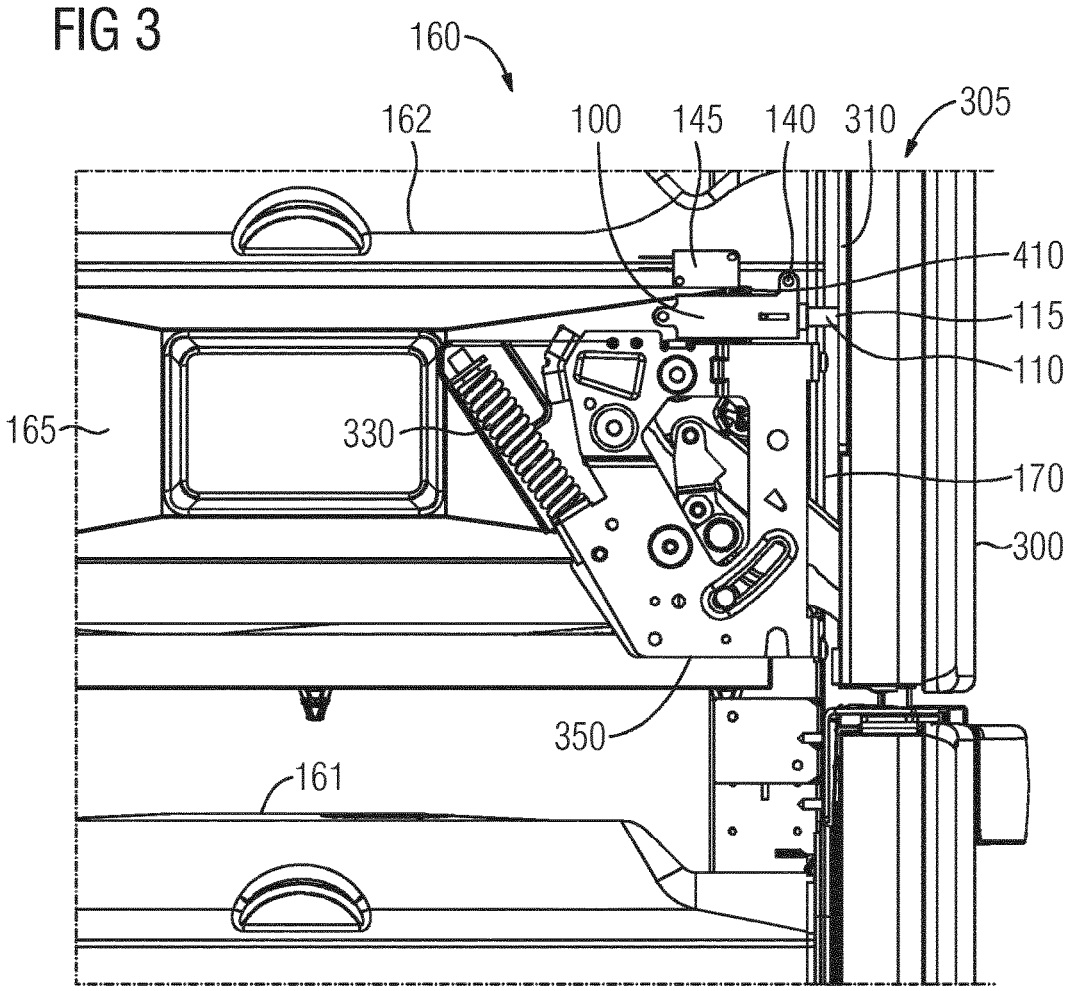
FIG. 3 shows another embodiment of a door damper arrangement according to the present invention.

FIG. 3 shows another example of an embodiment of a door damper arrangement according to the present invention 305. Here, the door damper is mounted above an e.g. double fulcrum hinge 310 that is spring-loaded. It is e.g. fixed to a sidewall of an oven cavity. The pestle 110 directly contacts a glass surface 310 of a door 300. It may be e.g. fixed by a screw through the orifice 140, or a suitable snap-in connection may be provided. Further two oven cavities may be identified, an upper cavity 162 and a lower cavity 161.

Figure 4:
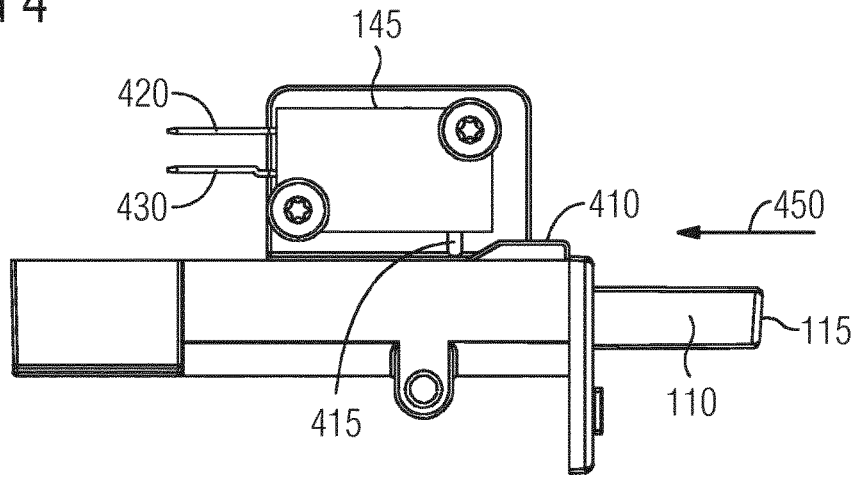
FIG. 4 shows details of a pestle of a door damper.

FIG. 4 shows an example of a pestle 110 used in combination with a door damper arrangement. The door damper may be, for instance, fixed on a sidewall 165 of an oven cavity 160 and operate on a front support structure 170 of a door as e.g. shown in FIG. 1. A front surface 115 of the pestle 110 that is beneficially made of plastic material may be inclined in order to better follow the shape of the contact surface that operates the pestle. In this case, the pestle is equipped with a notch 410. The notch operates a switch 145 that connects contacts 420 and 430 in order to establish an electrical contact, when the pestle is moved along the direction 450. In particular an actuator 415 of the switch 145 may be e.g. moved inward of the switch to close the contacts 420, 430. Such a switch may cause electrical activity in terms of a door alarm, a door lock, a light or suspending/activating cooking-related functions. Beneficially, the front surface 115 of the pestle may directly contact a glass or a support structure of the door.

The inventors have found that it is particularly advantageous to provide a door damper due to its flexible positioning properties in terms of constructions of a household appliance and thermal exposure.

LIST OF REFERENCE NUMERALS

100 door damper
110 pestle
115 front surface of pestle
120 housing
130 bracket
140 orifice
150 damper element
145 switch
125, 126 slot in housing to support pestle
160 household appliance
161 lower cavity
162 upper cavity
165 sidewall of household appliance
170 front frame
200, 305 embodiments of door damper arrangements
220 door
240 glass
230 support frame
235 support structure
210 hinge
280 angle
235 contact surface
300 door
200, 305 damper arrangement
310 glass
350 hinge support
330 spring
410 notch
415 actuator of switch
450 movement direction
420, 430 electrical contact

The invention claimed is:

1. A household appliance comprising a
a door supported at a hinge, and
a door damper mounted in a region of the household appliance in proximity to the hinge and having at least one cavity arranged opposite to the door and defining an opening plane section on that side,
wherein the door damper comprises a damper element and a pestle in force-transmitting contact with the damper element,
wherein the door comprises a support frame for supporting at least one glass panel, said door having at least one section where a section of said support frame supports at least two sections of said one glass panel, and
wherein the pestle is arranged to contact a side of said section of the support frame that is opposite a side of the section of the support frame that supports the glass panel,
wherein the pestle provides a front surface in contact with the door when the door is positioned in or within an angle relative to the opening plane, the angle being an angle between the door and the opening plane,
wherein, after the door contacts the pestle, further movement of the door toward the door damper actuates the pestle.

2. The household appliance according to claim 1, wherein the front surface of the pestle is formed to have a shape selected from the group consisting of the angle between the door and the opening plane, convex, oval, semicircular, tapered, rectangular, and flat.

3. The household appliance according to claim 1, wherein the pestle is fixed to the damper element and/or wherein the length of the pestle is at least partially adjustable.

4. The household appliance according to claim 1, wherein the pestle is actuated at an angle between 0° and 30°.

5. The household appliance according to claim 1, wherein the housing and/or the pestle is made from heat-resistant plastic material.

6. The household appliance according to claim 1, wherein the pestle has a shape adapted to operate a switch and/or has a notch, which may get in contact with an actuator in order to operate the switch.

7. The household appliance according to claim 1, wherein the damper element operates pneumatically or hydraulically and has a linear or a progressive damping characteristic.

8. The household appliance according to claim 1, wherein the door damper is mounted on a support structure that supports the hinge.

9. The household appliance according to claim 1, wherein the door damper is arranged on and/or in a region of a double fulcrum hinge.

10. The household appliance according to claim 1, wherein the door damper and/or the pestle is actuated by the door when a first force, which is provided by the hinge and applied to the pestle via the door, is reached, which exceeds a second force, which is a counterforce provided by the door damper and/or the pestle.

11. The household appliance according to claim 1, wherein the door damper can be fixed directly on a hinge and/or at associated mechanical parts.

12. The household appliance according to claim 1, wherein the door damper comprises a housing having a bracket, wherein the pestle is guided by the housing.

13. The household appliance according to claim 1, wherein the pestle is in connection with a switch.

14. The household appliance according to claim 4, said angle being between 5° and 25°.

15. The household appliance according to claim 4, said angle being between 0° and 10°.

16. The household appliance according to claim 5, said plastic material being heat-resistant up to 350° C. and/or being heat-insulating.

17. The household appliance according to claim 9, said double fulcrum hinge being spring-loaded.

18. The household appliance according to claim 10, wherein the first force and the second force are adapted to each other such that the door closes automatically with a predetermined closing speed, at least when positioned in an angle between 0° and 30°.

19. The household appliance according to claim 1, wherein the pestle is removably disposed in a housing of the door damper.

* * * * *